US006483779B1

(12) United States Patent
Teixeira

(10) Patent No.: US 6,483,779 B1
(45) Date of Patent: Nov. 19, 2002

(54) TIME INTERVAL AND EVENT DISPLAY DEVICE

(75) Inventor: Martin M. Teixeira, Aurora, CO (US)

(73) Assignee: Countdown Clocks International, Mineola, NY (US)

( * ) Notice: Subject to any disclaimer, the term of this patent is extended or adjusted under 35 U.S.C. 154(b) by 0 days.

(21) Appl. No.: 09/391,588

(22) Filed: Sep. 7, 1999

Related U.S. Application Data

(63) Continuation-in-part of application No. 08/197,156, filed on Feb. 16, 1994, now Pat. No. 5,999,492.

(51) Int. Cl.[7] ..... G04B 47/00; G04B 19/24; G04C 17/00

(52) U.S. Cl. ..... 368/10; 368/29; 368/223

(58) Field of Search ..... 368/10, 28, 29, 368/41–43, 107–113, 82–84, 223, 228, 239–242

(56) References Cited

U.S. PATENT DOCUMENTS

| | | | | |
|---|---|---|---|---|
| 4,005,571 A | | 2/1977 | Wolff | 58/39.5 |
| 4,193,255 A | | 3/1980 | Ebihara et al. | 368/34 |
| 4,303,995 A | | 12/1981 | Aizawa | 368/28 |
| 4,472,065 A | * | 9/1984 | Goodman | 368/71 |
| 4,630,935 A | | 12/1986 | Zettek | 368/41 |
| 4,831,605 A | | 5/1989 | Suga | 368/113 |
| 4,964,072 A | | 10/1990 | Nara et al. | 364/705.08 |
| 4,989,025 A | | 1/1991 | Matsumura et al. | 354/106 |
| 4,991,156 A | | 2/1991 | Suga | 368/113 |
| 5,022,016 A | | 6/1991 | Smith et al. | 368/223 |
| 5,031,161 A | * | 7/1991 | Kendrick | 368/280 |
| 5,058,085 A | * | 10/1991 | Lawler | 368/28 |
| 6,069,848 A | * | 5/2000 | McDonald et al. | 368/107 |

FOREIGN PATENT DOCUMENTS

| | | |
|---|---|---|
| JP | 1-141392 | 6/1989 |
| JP | 1-203991 | 8/1989 |

OTHER PUBLICATIONS

Advertisement from Banning Enterprises Ltd. (6 sheets).

* cited by examiner

*Primary Examiner*—Vit Miska
(74) *Attorney, Agent, or Firm*—Ostrolenk, Faber, Gerb & Soffen, LLP

(57) ABSTRACT

A time interval and event display device depicting a displayed event and a continuous time display informing the viewer of continuous time intervals from the unchanging event to the present time or the remaining time to a future unchanging event.

25 Claims, 2 Drawing Sheets

TIME INTERVAL AND EVENT DISPLAY DEVICE

RELATED INFORMATION

This application is a continuation-in-part application from Ser. No. 08/197,156 filed Feb. 16, 1994 U.S. Pat. No. 5,999,492. The entire disclosure of the prior application is considered to be part of the disclosure of the accompanying application and is hereby incorporated by reference.

BACKGROUND OF THE INVENTION

1. Field of the Invention

The present invention is generally directed to a time interval and event display device that couples a continuous time display with a visual representation of an important event and continuously informs the observer of the time interval from the represented event to present time, or remaining time to a future represented event.

2. Description of Prior Art

Electronic and mechanical time pieces having the capability to me a sure a and display lapse time from a starting time have been available for many years. These electronic devices use liquid crystal displays or analog display faces of time measurement to indicate lapse time or alternatively to start a signal when a particular time arrives. Mechanical devices are also used with or without some electronics. The only reference is time-lapsed seconds, minutes, hours, days, months and years measured from starting time to present time.

Some time pieces may record more than one event, such as explained in U.S. Pat. Nos. 4,630,935 and 4,303,995. These devices indicate a plurality of dates and relate elapsed time from a starting time of each date or time. All such time devices relate to calendar dates, time periods, and numerical relationships of beginning and ending elapse times.

The original event from which the elapse time is measured is known only to the operator of the time piece. Others observing the time piece have no reference to the starting event or time. The actual event that the referred elapse time measures must be stored separately in human memory, computers, notes, or note books. For long elapsed time periods of months or years, or when a plurality of times are recorded, remembering or finding the relationship of an elapse time indicator to an event becomes difficult.

A camera with an elapsed time indicator (U.S. Pat. No. 4,989,025) photographs a current event. This camera records the event but cannot display the picture. The developed picture does not display continually elapsing time. Additional photographs do not indicate the unchanging first event and only record a fixed and unchanging elapsed time.

Many people display reminders of significant events in their lifetimes to recall achievements, honors, and pleasant events. These include photographs and certificates of marriages, anniversaries, graduations, professional achievements, historical events, child births, animal births, employee recognition's, retirements, holidays, vacations, sports events etc. However these displays of the represented event do not reflect the increasing time to make the viewer aware of the continual passing of time or approaching time for a future represented event.

People striving to complete work before a future time event often mentally calculate remaining times but are not always aware of periods of time remaining to complete a task. This especially happens when many projects are pursued at the same time.

The present invention displays important events along with an associated continuing time indicator that will immediately remind the viewer of the event, indicate time interval from the event, and continue on in perpetual relation to the displayed event. If the depicted event is in the future, the present invention indicates and reminds the user of the time remaining to the displayed event to assist future planning and scheduling.

SUMMARY OF THE INVENTION

The present invention generally relates to a time interval and event display device that will visually and continually indicate to the viewer an accumulating or reducing time interval related to a displayed event. This time interval and event display device provides the viewer with immediate knowledge of the appropriate time span of the chronological measuring device related to an event without referring separately to a time indicator or to the reason the time measurement is being employed. The time interval reference relates to the depicted event and not the normal solar reference of time.

The time interval and event display device couples the time interval timing device having a visual numerical display along with the displayed event. This provides the viewer with a constant reminder of displayed events relative to changing time intervals to assist planning or recall the time intervals from pleasant or pertinent memories.

The time interval and event display device may also have included visual, mechanical, electronic or audible signaling devices programmed for future times to alert the owner of important times related to the displayed event. Alerts may include electronic email, phone calls, electronic pages etc. The time interval and event display device is capable of numerically measuring and displaying seconds, minutes, hours, days, weeks, months, or years separately or in any combination.

The time interval and event display device may be a video monitor with a depicted event displayed with the changing chronological time interval display where a computer or semiconductor microchips are programmed to indicate time intervals from past depicted events or remaining time to future depicted events.

Accordingly, one object of the invention is to visually inform or remind the viewer of continuous time intervals between a past event displayed on the device and the present time.

Another object of the invention is to visually inform or remind the user of continuous remaining time intervals between the present time and a future displayed event.

Another object of the invention is to provide programming of visual, audible, mechanical, electronic or any combination of these signals for future time alerts or reminders related to the displayed event.

Another object of the invention is to provide palpable reference of time intervals related to a palpably depicted event to inform or remind sightless people.

Another object of the invention is to use a video monitor as the time interval and event display device with a computer or semiconductor microchips providing the continuous relative time intervals from the present to past or future displayed event or events.

DETAILED DESCRIPTION OF THE PREFERRED EMBODIMENTS

Figure 1:
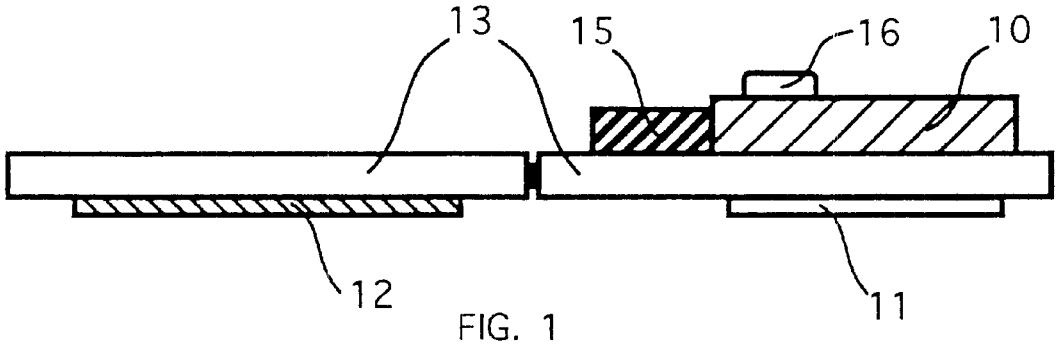
FIGS. 1 and 2 indicate top and front views of a time interval and event display device that visually couples a chronological time device having a continuous display of time intervals with a past depicted event or a future depicted event.
Figure 2:
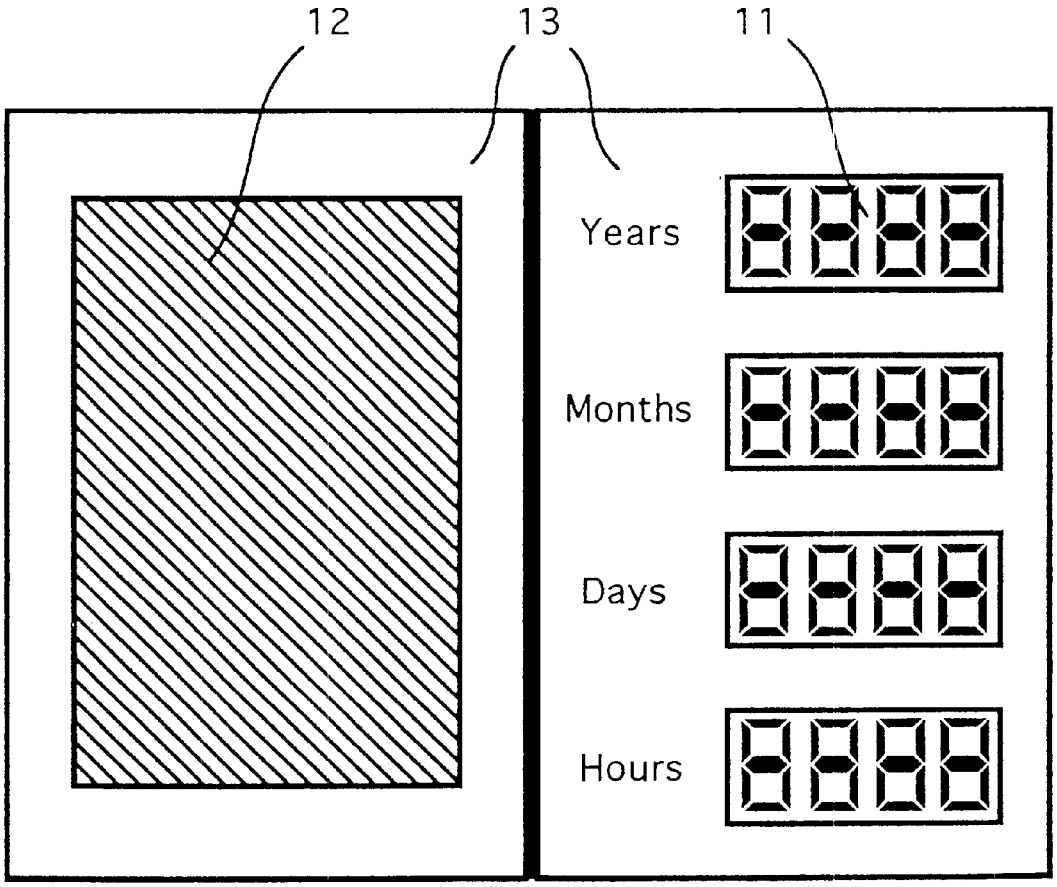
Figure 3:
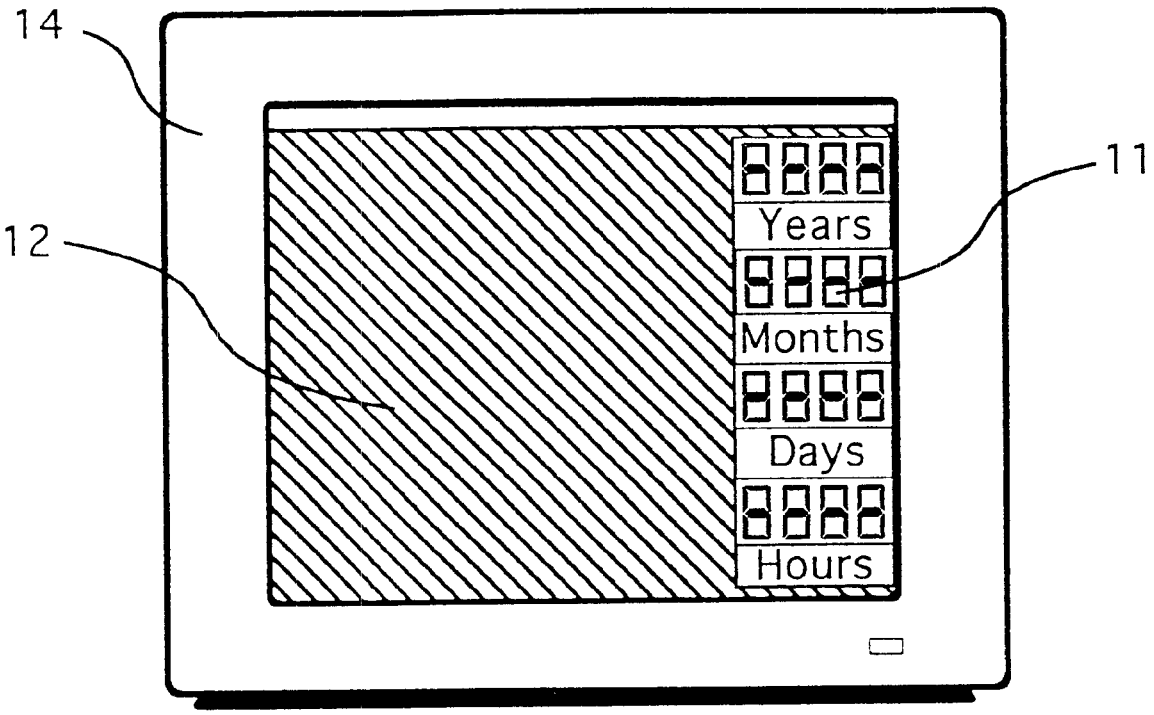
FIG. 3 indicates using a video monitor as a time interval and event display device.

The present invention of a time interval and event display device that will continually indicate to the viewer an accumulating or reducing time period related to a displayed event is shown in top view, FIG. 1, and front view, FIG. 2. This time interval and event display device couples in the same front view, FIG. 2, a continuing display of time intervals 11, a depicted event 12, on a means 13 of displaying and supporting the chronological time display with the depicted event. Located in conjunction with the time display 11 is a chronological measuring device 10 shown in top view, FIG. 1. FIG. 3 shows the present invention of a time interval and event display device as a video monitor 14, displaying an unchanging depicted event 12 on the video monitor coupled with a time interval and event display 11 of changing time intervals.

The chronological time device is designed to measure time intervals including seconds, minutes, hours, weeks, months, and years individually or in any combination. The type of chronological measuring device, chemical, mechanical, or electronic, used in the invention in the broadest sense is meant as a device to measure and indicate accumulating or reducing time periods. Some of these chronological time devices are described in U.S. Pat. Nos. 4,193,255, 4,303,995, 4,831,605, 4,964,072, 4,989,025, and 4,991,156. Japanese Patents JA 1-141392 and JA 1-203991 also describe chronological devices. The devices that include designs having a means for compensating variations of days in a month and leap years while maintaining correct time intervals are preferred.

The continuous interval time display may be combined with the chronological device as shown on the above referenced patents or be a separate component provided with time interval information from the chronological measuring device. When the chronological measuring device is measuring intervals from a past displayed event, the accumulating time is shown on the display. When the chronological device is measuring time to a future depicted event, the remaining time is shown. The time interval and event display device has a means to set a start or ending solar time by the user.

The chronological devices in addition to measuring time intervals contain functions including , a means for continuing operation in the event of any power failure, a means to compensate for changing time zones or daylight savings times, and a means to initiate and stop an audio signal, a visual signal, a written signal, a palpable signal, a maniacal signal, a electronic signal or any one method or combination of signals. Chronological device power sources may be chemical, alternating or direct electrical current or mechanical power devices, individually or combined. A means to signal low power may be included with battery driven power sources and or a means to switch power sources.

The time interval display should be coordinated with the chronological time device to display time intervals of seconds, minutes, hours, days, weeks, months and years individually or in any combination. The time interval display may be numerical, graphic or text. Time interval display devices use liquid crystal displays or analog display faces of time measurement to indicate time intervals but are not limited to these display methods. Preferably the time interval display is continual although there may be included a means to mask the display on demand without affecting the time intervals. The time display may have an option of being lighted. Descriptive time word units such as seconds, minutes, hours, days, weeks, months, or years are optional on the appropriate time division display.

The displayed event includes but is not limited to events, words, themes, awards, licenses, patents, diplomas, photographs, maps, projects, goals, documents, sentences, deadlines, or any information relating to time in the past or future. These past events could also include but not be limited to depicting weddings, births, deaths, vacations, anniversaries, assemblies, photographs, employment, or religious holidays. Future events may include depicting program or project deadlines, engagements, births, patent application deadlines, patent expirations, retirements, end of incarcerations, end of military service, graduation dates, vacation times, document expirations, certificate expirations, sports events, religious dates or any type of goals which the user desires to display a lapse time to. The time associated with the occurrence of the event may be displayed together with the event.

The means for displaying the chronological time display and the depicted event may include but not be limited to a single frame, plaque, planar or curved surface which maybe related to the event such as a foot all shaped display for lapse time to a football game. The means for displaying the depicted event also may not be related to the event and may include any combination of these joined sections of these means mentioned in this specification. The time interval and event display device could be attached to a wall, displayed on surfaces, made into jewelry, or adapted to any other object. The means for displaying the chronological device, may be constructed from but not limited to plastic, glass, crystal, stone, metal, wood, clay, paper, or combinations of these materials.

A single display means may include a plurality of time interval and event display devices, each having respective depicted events and displayed time intervals.

In this present invention the above descriptive words of depicted, visual, and display are intended for people having sight. For sightless people, "by palpable methods" should be applied after "depicted", "display", and "visual". The time interval display may also have a continuing audible time interval message relating to the depicted event.

A video monitor may be the time interval and event display device. If used with a computer, the depicted event can be scanned from a photograph, document, or any other source, and maintained on the video monitor. For a computer monitor, the depicted event can be maintained in memory with the appropriate continuing interval time display. The coupled depicted event with appropriate continually changing time on the same screen can be shown as "wall paper" or the "desk top" during computer operation to make the computer user aware of desired time intervals. Available computer software programs such as "Super Clock"® and others can be programmed to determine and show time intervals relating to said event. These time intervals may be selected to increase in time from a past event to present changing time or continually decrease in time from present time to a future depicted event.

Semiconductor microchips may also be used in the present invention of a time interval and event display device for determining time intervals, displaying time intervals, and related depicted events. The time interval display and depicted event could be shown on video monitors or other time interval and event display devices. The time interval and event display device is activated by applying a power source then depicting an event on the display and entering a solar time for the event in the time measuring device. The desired time intervals such as seconds, minutes, hours, days, years or any singular time or combination of times are selected and the interval time measuring device then displays the continuing time intervals relating to the depicted event. Time intervals may also be at differing rates of time and not limited to solar time. Examples of one such time rate would be time interval and event display device that keeps track of dogs ages which would be at seven times the normal rate of solar time.

From the above description of the invention, various changes and modifications on the device will occur to those skilled in the art. All such modifications coming within the scope of the appended claims are intended to be included therein:

What is claimed is:

1. A time interval and event display device comprising:

(a) means for visually displaying subject matter related to a past event, (b) means for displaying time intervals relating to a time of said past event, said time intervals increasing in time from the time of said past event to present time;

(c) said time intervals being provided by a means for continuously measuring said time intervals, and (d) a means for mounting said means for measuring said time intervals with said means for displaying said time intervals and said means for visually displaying subject matter related to the past event.

2. A time interval and event display device according to claim 1 wherein said means for continuously measuring said time intervals is combined with said means for displaying said time intervals.

3. A time interval and event display device according to claim 1 wherein said means for continuously measuring said time intervals and displaying said time intervals includes electronic devices.

4. A time interval and event display device according to claim 1 wherein said means for continuously measuring said time intervals and displaying said time intervals includes mechanical devices.

5. A time interval and event display device according to claim 1 wherein said means for measuring said time intervals is capable of measuring desired seconds, minutes, hours, days, weeks, months, and years as desired.

6. A time interval and event display device according to claim 1 wherein said means for measuring said time intervals is capable of measuring time intervals other than solar time.

7. A time interval and event display device according to claim 1 wherein said means for displaying time intervals also displays the time of said past event.

8. A time interval and event display device according to claim 1 wherein said means for measuring said time intervals includes an actuator means for setting a time relating to said event and current time.

9. A time interval and event display device according to claim 1 wherein said means for continuously measuring said time intervals includes a means for setting a time for providing a signal wherein said signal comprises one of an acoustical, visual, electronic, and palpable signal.

10. A time interval and event display device according to claim 1 wherein said means for continuously measuring said time intervals includes a means for activating an alarm indicating low power supply or for switching power supplies.

11. A time interval and event display device according to claim 1 wherein said means for continuously measuring said time intervals includes a means for adjusting said time interval when time error occurs.

12. A time interval and event display device according to claim 1 wherein said means for displaying said time intervals and said means for visually displaying subject matter related to the event includes palpable methods.

13. A time interval and event display device according to claim 1 wherein said means for mounting provides for a plurality of said time interval and event display devices.

14. A time interval and event display device according to claim 1 wherein said means for mounting includes materials comprising at least one of plastic, glass, crystal, metal, wood, clay, rock, and paper.

15. A time interval and event display device comprising:

(a) a video monitor displaying subject matter related to an event and time intervals relating to a time of said event, (b) said time intervals selected to increase in time from a time of a past event having the subject mater related thereto displayed on the video monitor to present time, or said time intervals selected to decrease in time from present time to a time of a future event having the subject matter related thereto depicted on the video monitor, and (c) said time intervals, and the subject matter related to the event being provided by a computer and computer software.

16. A time interval and event display device according to claim 15 wherein the time intervals, said subject matter relating to the event, and said display of time intervals are provided by semiconductor microchips.

17. A time interval and event display device according to claim 15 wherein said means for measuring said time intervals is capable of measuring desired seconds, minutes, hours, days, weeks, months, and years as desired.

18. A time interval and event display device according to claim 15, wherein said video monitor also displays the time of the event.

19. A time interval and event display device according to claim 15 wherein said computer and computer software comprises means for continuously measuring said time intervals including means for setting a time for providing a signal wherein said signal comprises one of an acoustical, visual, and palpable signal.

20. A time interval and event display device according to claim 15 wherein said computer and computer software includes means for continuously measuring said time intervals including a means for adjusting said time intervals when time error occurs.

21. A time interval and event display device according to claim 15 wherein said video monitor provides for a plurality of said time interval and event display devices.

22. A time interval and event display device according to claim 15, wherein said time intervals and the subject matter related to the event provided by the computer and computer software comprises a screen display on said video monitor which comprises one of video wallpaper, a desktop display screen or a screen saver screen displayed by said video monitor.

23. A time interval and event display device comprising:

means of visually displaying subject matter related to an event;

means for displaying time intervals relating to a time of said event, said time intervals selected to increase in time from a time of a past event to present time or selected to decrease in time from present time to a time of a future event;

said time intervals being provided by means for continuously measuring said time intervals; and means for mounting said means for measuring said time intervals with said means for displaying said time intervals and said means for visually displaying subject matter related to the event;

said means for measuring said time intervals being capable of measuring in seconds, minutes, hours and days.

24. A time interval and event display device according to claim 23, further wherein the means for measuring said time intervals is capable of measuring in years.

25. A time interval and event display device according to claim 24, wherein said means for measuring said time intervals is capable of measuring in at least one of weeks and months.

* * * * *